US009150991B1

(12) United States Patent
Kalkbrenner

(10) Patent No.: US 9,150,991 B1
(45) **Date of Patent: *Oct. 6, 2015**

(54) SEWING MACHINE FEED DEVICE

(71) Applicant: Daniel K. Kalkbrenner, Fox River Grove, IL (US)

(72) Inventor: Daniel K. Kalkbrenner, Fox River Grove, IL (US)

(73) Assignee: US Sewing Automation, Inc., Gilberts, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/505,606

(22) Filed: Oct. 3, 2014

(51) Int. Cl.

| | |
|---|---|
| ***D05B 3/04*** | (2006.01) |
| ***D05B 19/16*** | (2006.01) |
| ***D05B 27/08*** | (2006.01) |
| ***D05B 27/16*** | (2006.01) |
| ***D05B 27/10*** | (2006.01) |

(52) U.S. Cl.
CPC ..... *D05B 19/16* (2013.01); *D05B 27/08* (2013.01); *D05B 27/10* (2013.01); *D05B 27/16* (2013.01)

(58) Field of Classification Search
CPC ..... D05B 27/10; D05B 27/14
USPC ..... 112/470.06, 470.13, 27, 47, 318, 80.32, 112/308, 322, 323, 324, 470.33, 470.14, 112/470.17, 470.18, 470.01, 470.03, 475.04
See application file for complete search history.

(56) References Cited

U.S. PATENT DOCUMENTS

| | | | | |
|---|---|---|---|---|
| 3,435,790 | A * | 4/1969 | Hale | 112/322 |
| 4,100,864 | A * | 7/1978 | Babson et al. | 112/470.01 |
| 4,145,983 | A * | 3/1979 | Law et al. | 112/317 |
| 4,593,636 | A * | 6/1986 | Schips | 112/308 |
| 6,026,756 | A * | 2/2000 | Frazer et al. | 112/118 |
| 7,401,563 | B2 * | 7/2008 | Sho | 112/308 |
| 7,444,951 | B2 * | 11/2008 | Ishikawa et al. | 112/475.04 |
| 8,402,903 | B2 * | 3/2013 | Tseng et al. | 112/324 |
| 8,850,999 | B1 * | 10/2014 | Kalkbrenner | 112/470.18 |

* cited by examiner

*Primary Examiner* — Tejash Patel
(74) *Attorney, Agent, or Firm* — Mathew R. P. Perrone, Jr.

(57) ABSTRACT

A feed mechanism for a sewing machine, either separate from the rest of the machine or incorporated as a part thereof, greatly improves quality of sewn products, permits a multitude of stitches and increases production rates with less labor content.

17 Claims, 9 Drawing Sheets

SEWING MACHINE FEED DEVICE

This invention relates to a sewing machine feed device and, more particularly, to a sewing machine feed device separately driven from the rest of the sewing machine, which can feed the sewn product independently of the other sewing machine mechanisms, and which can be configured so as to feed the fabric in any direction, and which can replace existing sewing machine feed mechanisms, without being an add on device to the sewing machine feed devices.

CROSS REFERENCE TO RELATED APPLICATION

This application is a continuation in part of U.S. patent application Ser. No. 12/931,853, filed Feb. 10, 2011, and now U.S. Pat. No. 8,850,999; filed by the same inventive entity.

BACKGROUND OF THE INVENTION

In order to effectively use a sewing machine, it is very desirable to control the feeding of the fabric through the machine to achieve special effects on the material being sewn. To that end, many devices are known to assist this function. These devices primarily employ mechanisms mechanically arranged to achieve an elliptical motion of the fabric feeder.

This elliptical motion results from a vertical motion imparted to the cloth feeder combined with a horizontal motion. The feeder rises up to engage the fabric and simultaneously starts moving the fabric horizontally. The vertical motion reaches its peak and begins to drop down as the horizontal motion continues to feed the fabric. When the feeder drops below the cloth support plate the fabric stops moving, the feeder continues down and starts returning horizontally. The fabric is held stationary during this return cycle by the clamping pressure of the presser foot. The feed returns to the start position and begins the vertical motion all over again, repeating the cycle.

The current mechanical feed mechanism incrementally moves the fabric in a straight line. The sewing machine operator must guide the fabric manually to achieve a curved stitch pattern. There are available various add on devices to manipulate the fabric as comes into the sewing machine or during the sewing process itself to assist or replace the sewing machine process itself. Also, in some sewn products, there could be a series of discreet areas to be sewn, not connected to each other. The operator must sew one area, stop, trim threads, reposition manually and start sewing the second area.

The current cloth feeding mechanisms are mechanically linked to the other sewing mechanisms (for example needle mechanism, hook mechanism, looper mechanisms, and so forth) to provide synchronous motions to produce a stitch. The prior art feed mechanism control features are also all mechanically arranged. Stitch length (the increment the fabric moves for each machine cycle) is adjusted by turning a dial to move a linkage, or by adjusting a mechanical eccentric, or by changing eccentric cams. These changes complicate the sewing process.

Better control of the fabric or material feeding through a sewing machine can greatly improve production and quality of sewn products. For the purposes herein fabric and material may be used interchangeably unless otherwise specified. To achieve this feeding of material or fabric with programmability and ease of control offers great advantages. Such features are currently unavailable in the art, unless the sewing machine has many complicated devices attached thereto.

SUMMARY OF THE INVENTION

Among the many objectives of this invention is the provision of an improved sewing machine feed device to facilitate feeding fabric through a sewing machine.

An objective of this invention is a fabric feeding mechanism that is separately driven from the other mechanisms of a sewing machine.

A further objective of this invention is a fabric feeding mechanism that can transport the fabric in any direction.

A still further objective of this invention is a fabric feeding mechanism that is programmable.

Yet a further objective of this invention is a fabric feeding mechanism that has easily operated controls.

Also an objective of this invention is a fabric feeding mechanism that can produce a feed motion curve that is programmable.

Another objective of this invention is a fabric feeding mechanism that is capable of providing a programmable stitch length.

Still another objective of this invention is a fabric feeding mechanism that can produce a sewing path that is programmable.

Yet another objective of this invention is a fabric feeding mechanism that can feed the fabric with a "joystick" type control.

A further objective of this invention is a fabric feeding mechanism that can easily feed fabric in reverse (backtrack).

A still further objective of this invention is a fabric feeding mechanism that can move fabric in a zig-zag pattern.

Yet a further objective of this invention is a fabric feeding mechanism that can be programmed to move fabric in a pattern to produce buttonholes.

A still further objective of this invention is a fabric feeding mechanism that can be programmed to move fabric in a pattern to produce eyelets.

Also an objective of this invention is a fabric feeding mechanism that can move fabric to do basting.

Another objective of this invention is a fabric feeding mechanism that can move fabric to do tacking.

Still another objective of this invention is to provide a fabric feeding mechanism that can be adapted to a wide variety of sewing machines.

Yet another objective of this invention is to provide a fabric feeding mechanism that can make an effective use of an eccentric motion.

These and other objectives of the invention (which other objectives will become clear by consideration of the specifications, claims and drawings as a whole) are met by providing a feed mechanism for a sewing machine, either separate from the rest of the machine or incorporated as a part thereof, that will greatly improve quality of sewn products and increase production rates with less labor content, by using an eccentric motion and other variations of the feed device.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
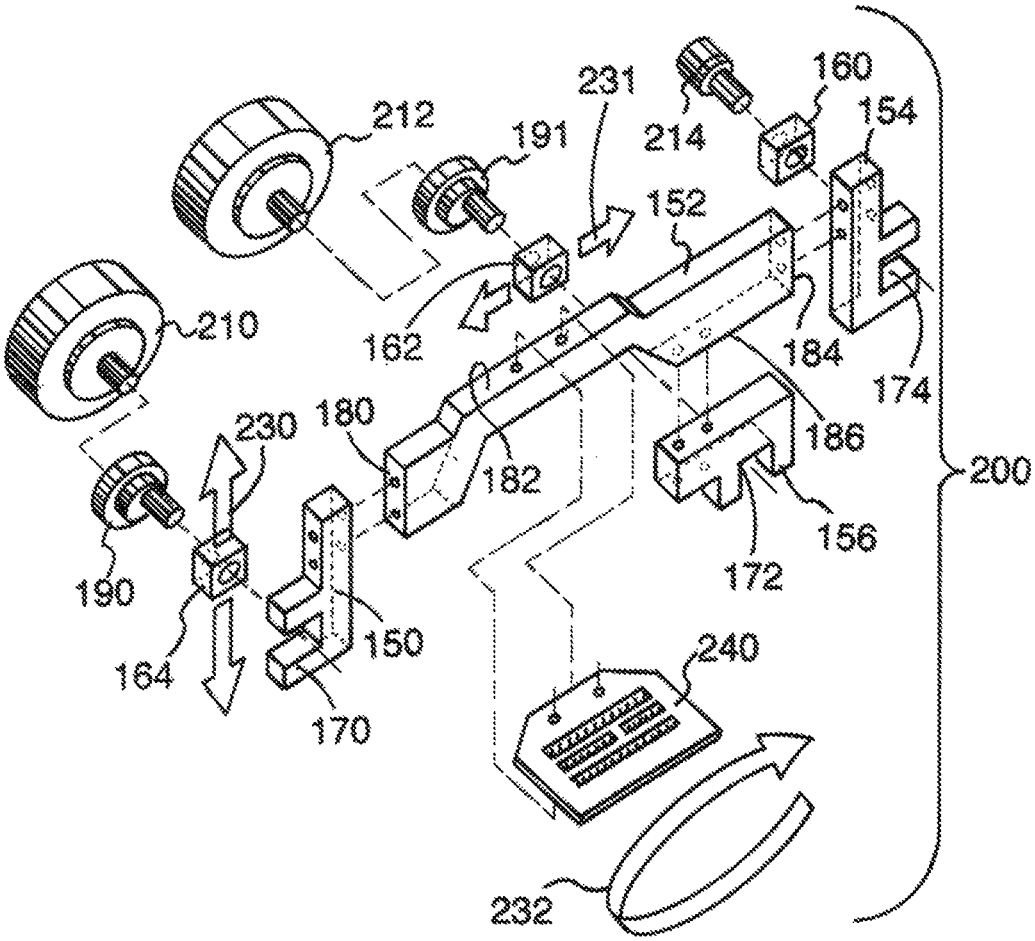
FIG. 1 depicts an exploded, perspective view of the linear drive feature 200 for the sewing machine feed device 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The feed mechanism for the sewing machine may be separate from the rest of the machine or incorporated as a part thereof. It can feed the fabric independent of the other sewing machine mechanisms and, with the addition of the rotational or cross feed components of the feed mechanism, fabric can be fed in any direction. The feed dog moving in an elliptical path transports material over the throat plate. There are three computer controlled servo drive motors driving the feed mechanism: a vertical drive motor (feed lift), a horizontal drive motor (feed travel), and a rotational drive motor or a cross drive travel drive motor, all linked to a motor controller, a programming device or computer, and operator control panel or display. In the case of the rotational feed mechanism a "joy stick" type input device can be used to "steer" the fabric in any desired direction or path.

Typical sewing machines to which this feed mechanism can be adapted to include, but are not limited to: Lockstitch Machines—301 type stitch, Differential Feeds, Top Feeds, Feed-Off-Arm Type Machines, Chainstitch Machines—401 type stitch, Feed-Up-Arm Type Machines, Coverstitch Machines, Blindstitch Machines, Zig-Zag Machines, Overlock Machines (Sergers), Tackers, and Pattern Sewers.

Referring now to FIG. 1, the sewing machine feed mechanism 200 is provided by a grouping of parts including the feed bar 152. The feed lift bracket 150 communicates with the feed bar 152 at one end with pivot bracket 154 at the other end of feed bar 152. The feed travel bracket 156 is secured to the feed bar 152 adjacent to the pivot bracket 154.

First drive block 160 communicates with the pivot cradle 174 on pivot bracket 154. Second drive block 162 communicates with the feed travel drive block cradle 172 on the feed travel bracket 156. Then third drive block 164 communicates with feed lift drive block cradle 170 on the feed lift bracket 150. Thus, front end 180 of feed bar 152 supports the feed lift bracket 150. The top end 182 of feed bar 152 receives the feed dog 240. The back end 184 of feed bar 152 has a pivot bracket 154 secured thereto. The bottom side 186 of feed bar 152 has feed travel bracket 156 secured thereto.

The feed lift eccentric 190 communicates with third drive block 164 and is driven by feed lift servo motor 210. The feed travel eccentric 191 communicates with second drive block 162 and is driven by feed travel servo motor 210. Pivot pin 214 cooperates with first drive block 160. This structure provides cooperation between vertical feed lift motion 230 of third drive block 164 and horizontal feed travel motion 234 of drive block 162. Elliptical motion 232 of the feed dog 240 on the feed bar 152 occurs when the feed lift servo motor 210 and the feed travel servo motor 212 are rotated in conjunction.

The vertical or feed lift servo motor 210, and horizontal servo drive motor or feed travel servo motor 212 are capable of being programmed to achieve an elliptical motion. In addition, the motors can be programmed to achieve non-elliptical feed motions. For example, the feed motion could rise slowly vertically so as to reduce damage to the fabric, then move horizontally and retract down quickly and return horizontally quickly.

Also, the feed motion stitch length can be programmed by adjusting the time span for the vertical motion or by advancing the vertical motion partially and then retracting (partial rotation of the motor). The motors can also be programmed to do reverse feeding simply by changing the timing of when the vertical motion is activated relative to the horizontal motor. The "tacking" operation can be done with this type of sewing machine feed mechanism by simply programming the motors to move the fabric forward one stitch length and back one stitch length for a set number of sewing machine cycles.

Finally, this feed mechanism with separately driven motors can feed the fabric while not sewing. This can be used to achieve any desired stitch length for example by feeding the fabric in increments, sewing one stitch, and feeding the fabric again in increments and sewing one stitch, the effect is a long stitch length. This can be used to do "basting" where one or several stitches are put into a sewn product to temporarily hold pieces together. This is done in a number of areas that could now be programmed into a pattern where the product is moved automatically to the various points where basting is done without operator involvement.

A third programmable servo motor or rotation servo motor 140 can be added to this feed mechanism to achieve fabric feeding in a desired or any direction or pattern as will be described next.

Figure 2:
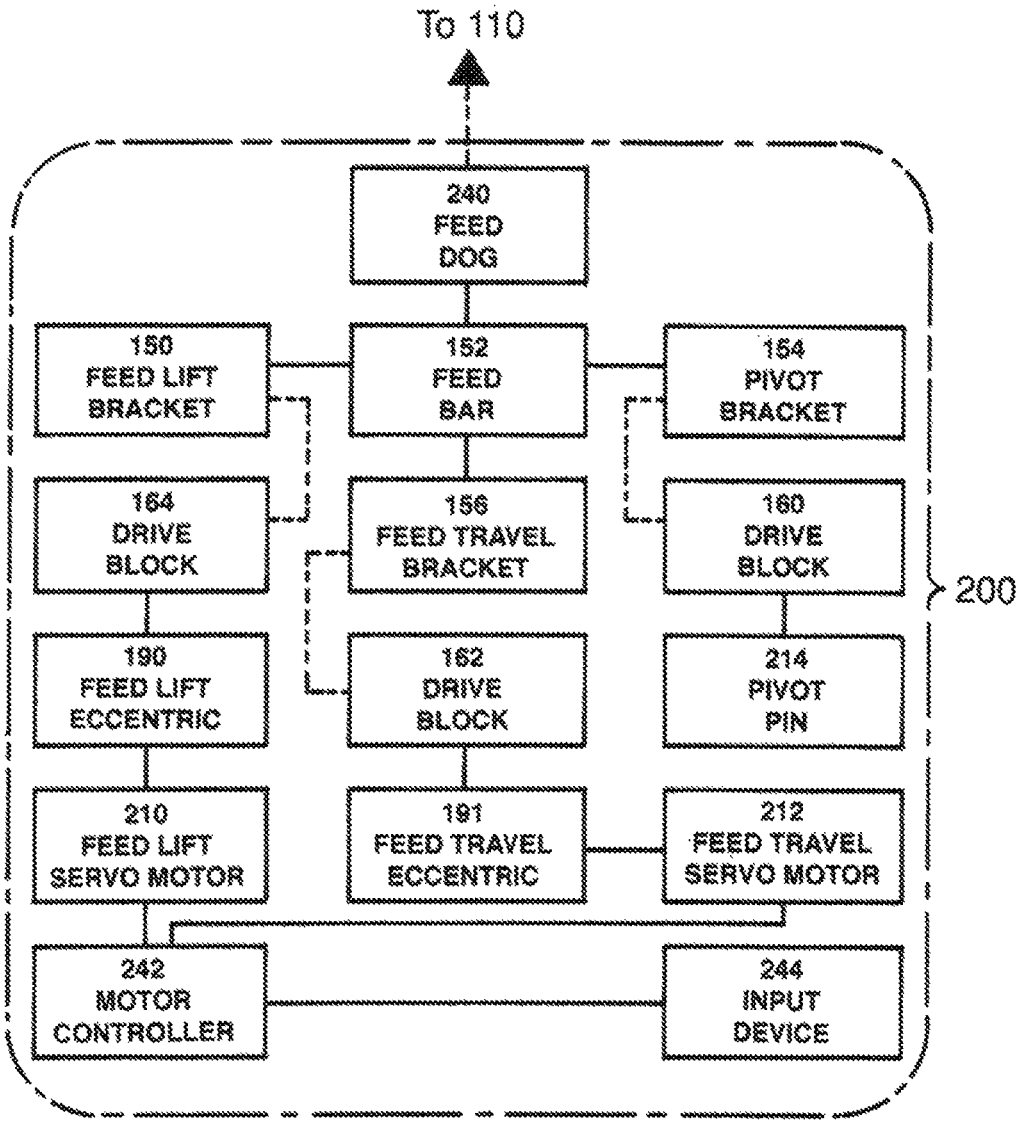
FIG. 2 depicts a block diagram of rotation feature 106 for the sewing machine feed device 100 of this invention.

Adding FIG. 2 to the consideration, rotation feature 106 is depicted. Needle plate 110 is connected to support plate 112. Support plate 112 is supported by one or two of support post 114. Support post 114, singly or more, receive rotation base plate 116. Rotation base plate 116 supports two sets of groove rollers 120. One set of grooved rollers 120 is connected to guide rails 126. The other set of grooved rollers 120 is optionally connected to guide rails 126. Guide rails 126 rest on rail support plate 118.

Segment gear 130 is connected to rotation plate 116 and meshes with pinion gear 132. Pinion gear 132 is operated by rotation servo motor 140. Rotation servo motor 140 is in turn operated by motor controller 242. Input device 244 feeds information to motor controller 242 to control servo motor 140.

Input device 244 and motor controller 242 may be joint or separate devices. Motor controller 242 or input device 244 may be a joy stick, a computer or other appropriate device. With such a structure, the elliptical motion 232 of FIG. 1 may be adjusted to any desired shape. The structure of motor controller 242 and input device 244 may be applied to the feed lift servo motor 210 or the feed travel servo motor 212 of FIG. 1 or any other servo motor herein.

Figure 3:
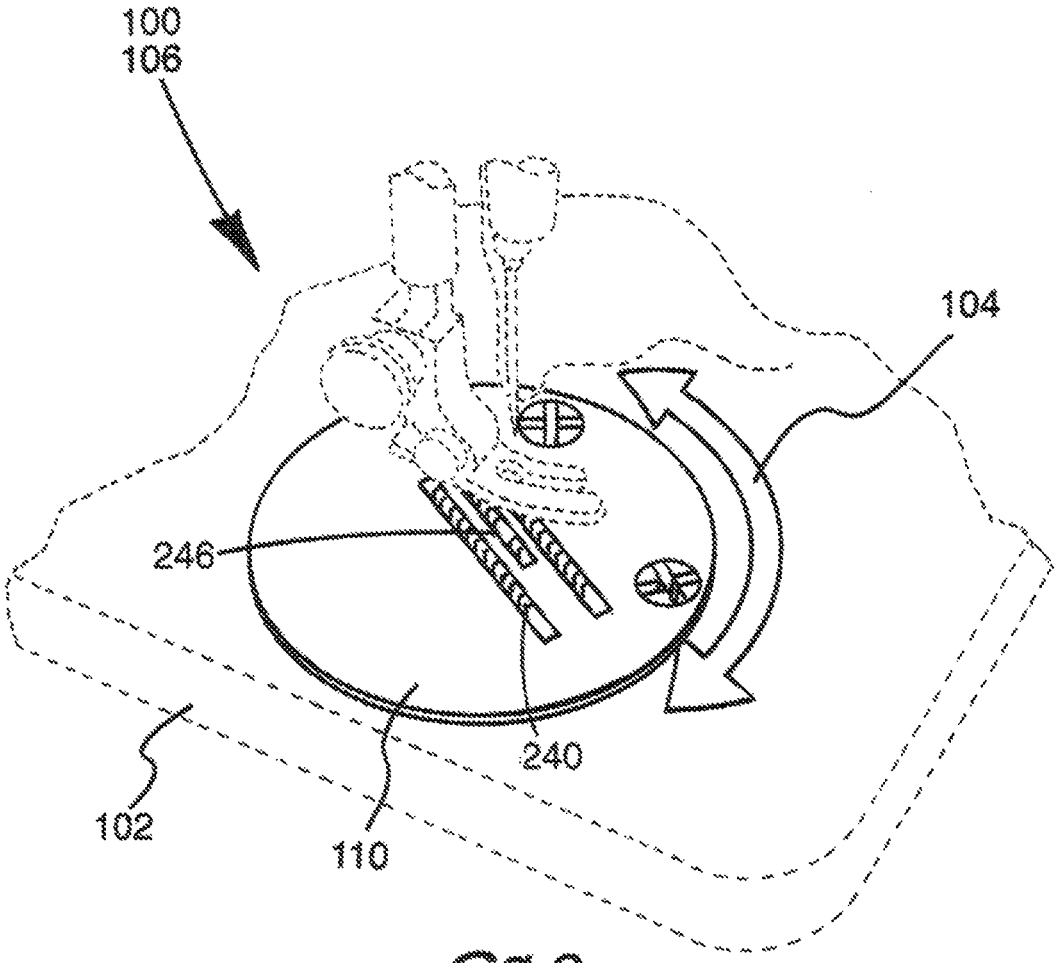
FIG. 3 depicts a top perspective view of the sewing machine feed device 100 with sewing machine 102 in phantom.

Referring to FIG. 3, sewing machine feed device 100 is positioned on sewing machine 102 under a right turn indicator 104 where needle plate 110 rotates. The feed device 200 and the rotation feature 106 provides a fabric transport method through the sewing machine 102 that is programmable, that can feed fabric in any direction and that is readily controllable and flexible.

Figure 4:
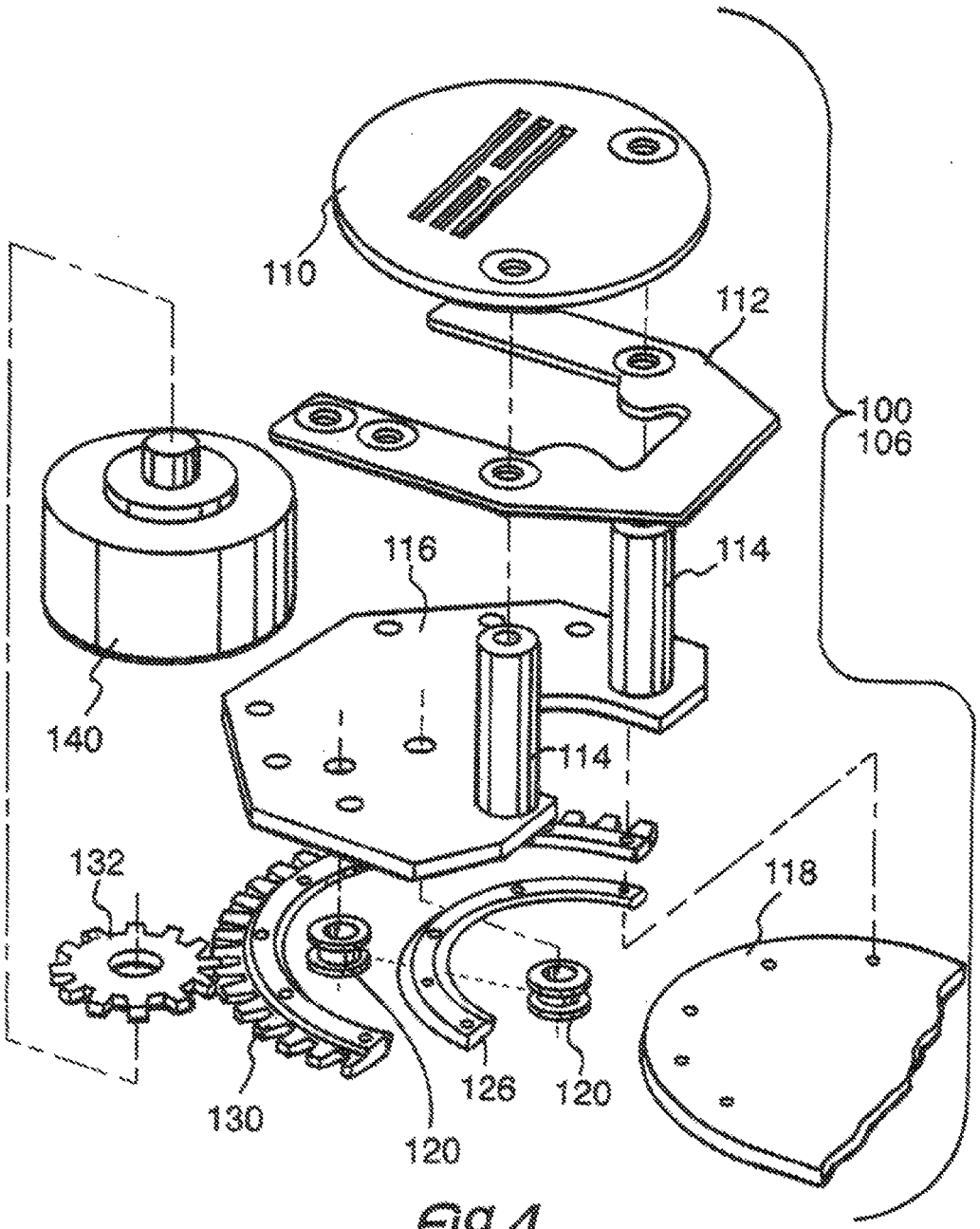
FIG. 4 depicts an exploded view of the sewing machine feed device 100 of this invention with rotation feature 106.

In FIG. 4, sewing machine feed device 200 is shown with its rotation feature 106. Needle plate 110 is mounted over support plate 112. Support plate 112 sits on a pair of support posts 114. Support posts 114 provide connection between support plate 112 and rotational base plate 116.

Below the rotational base plate 116 is a rail support plate 118. Mounted between rotational base plate 116 and rail support plate 118 is guide rail 126. While guide rail 126 is secured to support plate 118, it is not directly secured to rotational base plate 116. Grooved rollers 120 are secured to rotational base plate 116, preferably in a rotational fashion. The grooved rollers 120 are four in number and positioned on opposing sides of guide rail 126.

Segment gear 130 is mounted and secured to rotational base plate 116. Segment gear 130 contacts and meshes with pinion gear 132. Pinion gear 132 is mounted on and secured to the rotational servo motor 140, so that a desired rotation can occur. Rotational servo motor 140, mounted in this structure, permits efficient feeding of material through a sewing machine 102 (FIG. 3).

Figure 5:
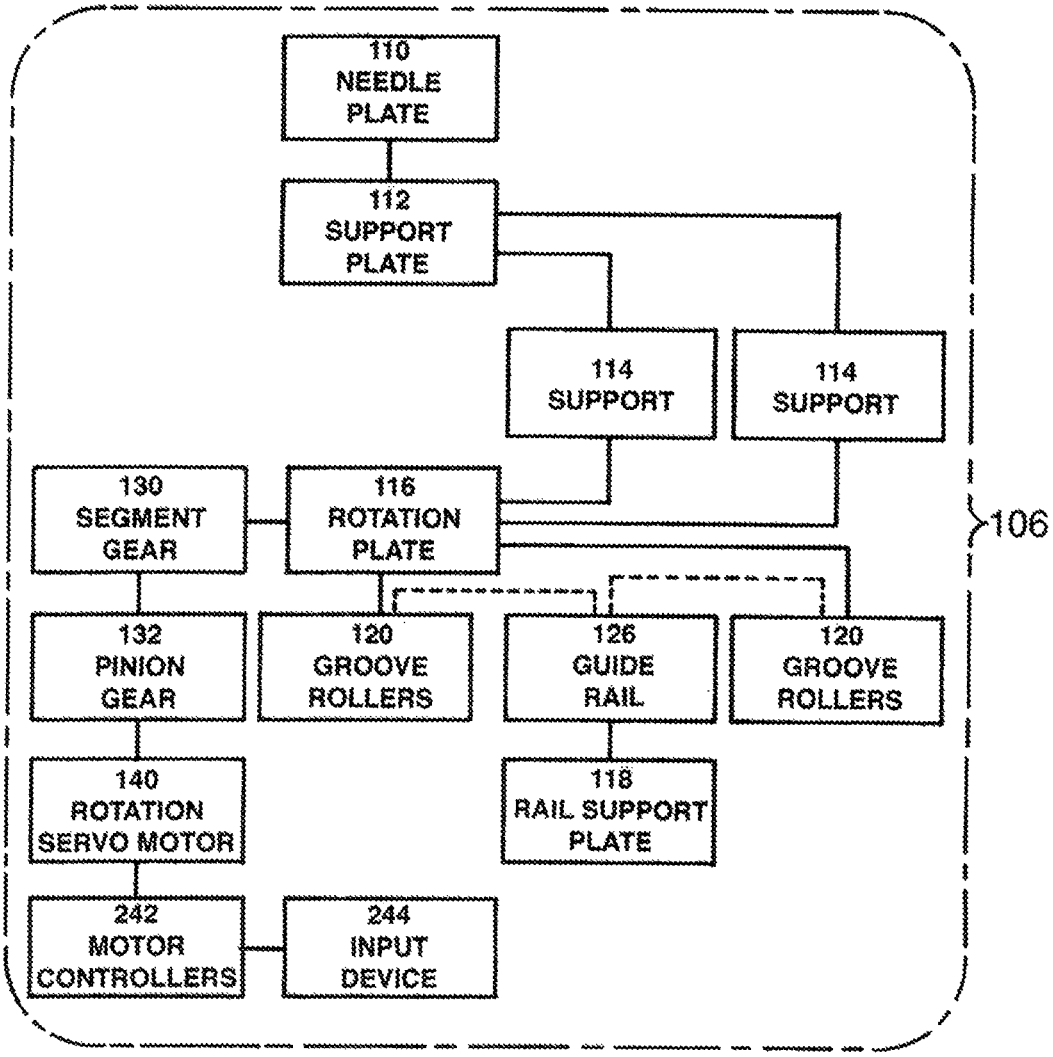
FIG. 5 depicts a block diagram of the linear drive feature 200 for the sewing machine feed device 100 of this invention.

In FIG. 5, the linear drive feature 200 is further explained in block diagram form as connecting to needle plate 110. More particularly feed dog 240 communicates with needle plate 110. Feed dog 240 also communicates with feed bar 152. Feed bar 152 is connected to feed lift bracket 150, pivot bracket 154, feed travel bracket 156. Depending on the desired function, at least one of three procedures are followed. In fact elliptical systems and variations thereof may be achieved.

In one case, feed lift bracket 150 is optionally connected to third drive block 164. Third drive block 164 is connected to feed lift eccentric 190. Feed lift eccentric 190 is operated by feed lift servo motor 210. Feed lift servo motor 210 is operated motor controller 242 and input device 244 as above described.

In another case, feed bar 152 is connected to feed travel bracket 156. Feed travel bracket 156 cooperates with second drive block 164, which in turn is connected to feed travel eccentric 191. Feed travel eccentric 191 is operated by feed travel servo motor 212, which in turn, is controlled input device 244 as above described.

In still another function, pivot bracket 154 cooperates with first drive block 160 as mounted on pivot pin 214. The set ups are selectively operated in any desired combination.

With the rotational feature 106, the feed mechanism can now feed the fabric in any direction. With the feed dogs in the down position the needle plate is rotated by the rotational servo motor so that the feed dogs are pointing in the desired direction. When the feed dogs are on the vertical portion of their elliptical path they engage the fabric and then move the fabric horizontally in the direction set by the rotational motor. The feed dogs then retract down, the rotational motor repositions to the next desired direction and the cycle repeats. The fabric must be held stationary by the presser foot during the needle plate rotation. By a combination of programming the rotational motor with the forward and reverse directions of the horizontal and vertical motors any fabric direction can be achieved.

The control of the fabric movement can be accomplished with a joystick. A joystick is an input device consisting of a stick that pivots on a base and reports its angle or direction to the device it is controlling. The left, right, forward, and backward motion of the fabric could be controlled with a joystick.

The fabric motion can also follow a programmed path. The location of each stitch can be inputted into a computer and stored. Various programs can then be called up and used to drive the fabric feed mechanism and sewing machine to produce an infinite variety of paths, curves, patterns, and stitch types.

Figure 6:
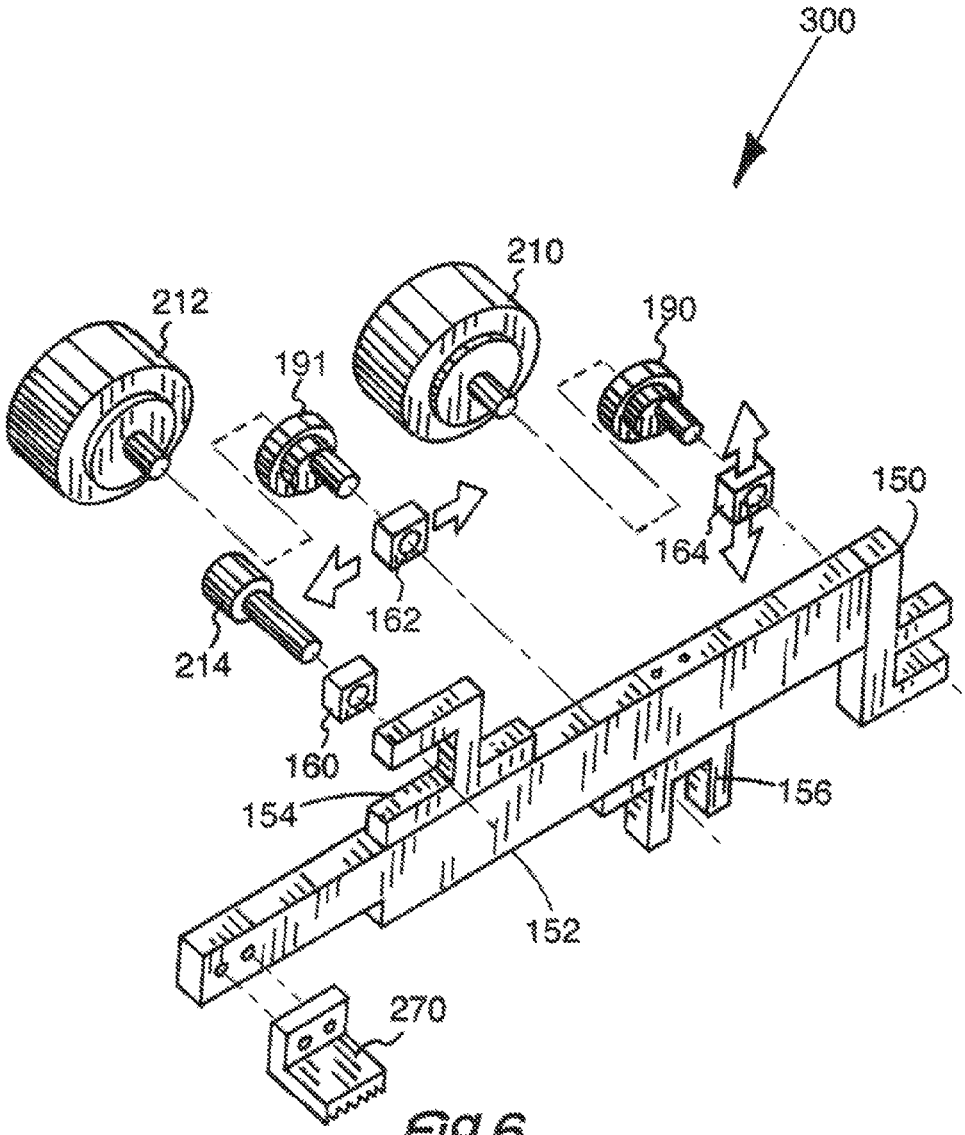
FIG. 6 depicts an exploded, perspective view of a second sewing machine feed device 300 for the sewing machine feed device 100 of this invention.

FIG. 6 depicts another embodiment of a sewing machine feed mechanism with second sewing machine feed device 300. This top feed arrangement can be incorporated into a typical blindstitch machine. In this case, the feed dog 270 grips the fabric from the top. The primary feed dog 270 again moves in an elliptical motion driven by the vertical servo motor or feed lift servo motor 210 and its eccentric 190 and first drive block 160 and the horizontal servo motor or the feed travel servo motor 212 and its eccentric 191 and second drive block 162. The primary feed dog 270 may also grip the fabric from the top and pulls the fabric through the sewing machine 102. Pivot pin 214 works to hold first drive block 160 in position pivot bracket 154 of motion bracket 152. Feed travel bracket 156 of motion bracket 152 receives second drive block 162. Feed lift bracket 150 of motion bracket 152 receives third drive block 164. This structure permits the feed dog 270 to operate efficiently.

Figure 7:
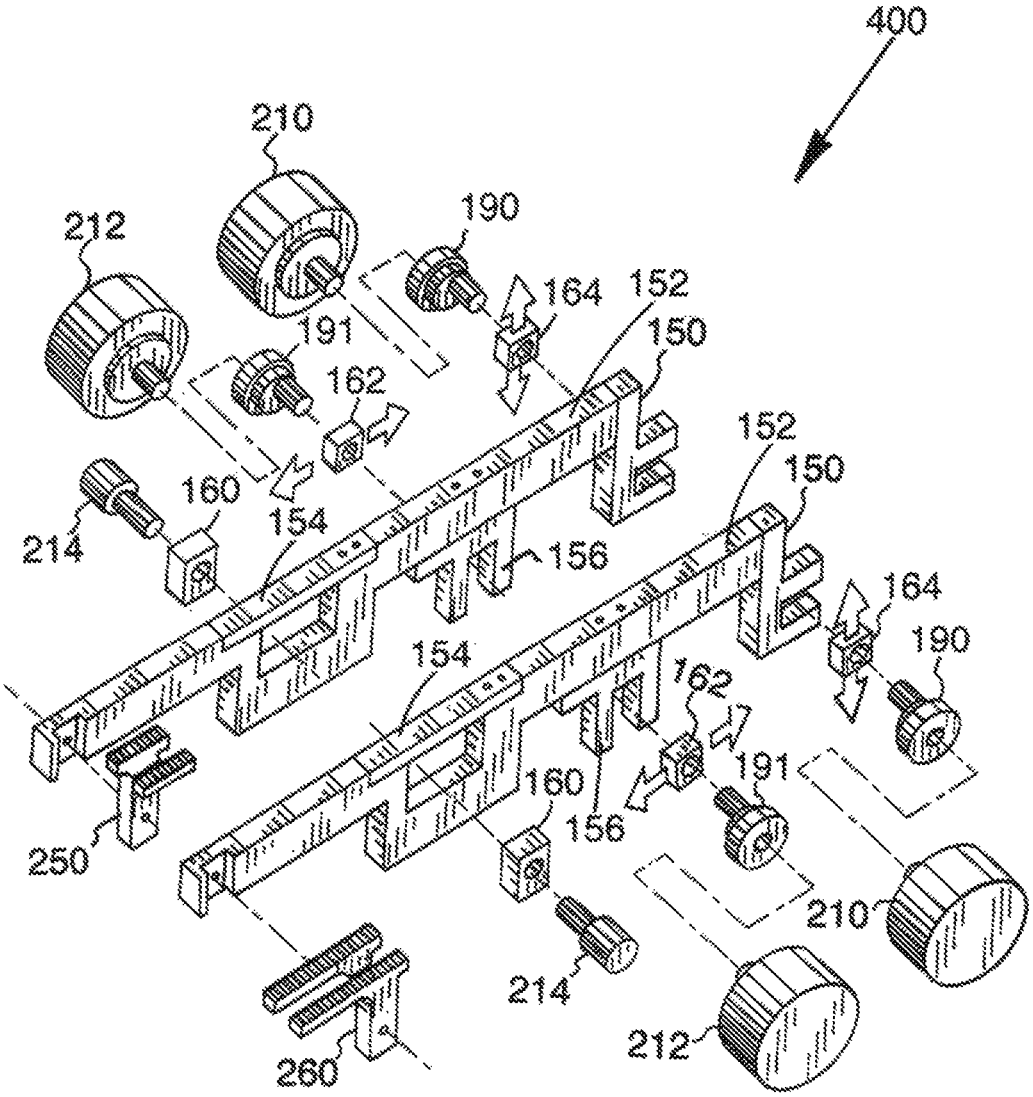
FIG. 7 depicts an exploded, perspective view of a third sewing machine feed device 400 for the sewing machine feed device 100 of this invention.

In FIG. 7, another embodiment of sewing machine feed device 100 in the form third sewing machine feed device 400 is shown. A differential feed is accomplished. Two mechanisms are arranged side-by-side such that the first feed dog 250 is behind the second feed dog 260. Each side can be activated separately. When first feed dog 250 is programmed to move a greater horizontal distance than second feed dog 260 the fabric is gathered. When first feed dog 250 is programmed to move less than second feed dog 260 the fabric is stretched. Having the capability to program the sewing machine, when the fabric is to be gathered or stretched, can be important when sewing knit materials that act differently when pulled in different directions.

In this case, there are two feed mechanisms placed side-by-side. The motors can be programmed so that the first feed dog 250 can move a greater horizontal distance than the second feed dog 260 resulting in stretching the fabric. When the first feed dog 250 is programmed to move a lesser horizontal distance than the second feed dog 260 the fabric 110 is gathered as desire.

This is basically a duplicate version of FIG. 6. Each of first feed dog 250 can move a greater horizontal distance than the second feed dog 260 motion is driven by its own vertical servo motor or feed lift servo motor 210 and its own eccentric 190 and first drive block 160; and the horizontal servo motor or the feed travel servo motor 212 and its eccentric 191 and second drive block 162. Each pivot pin 214 works to hold first drive block 160 in position pivot bracket 154 of motion bracket 152. Feed travel bracket 156 of motion bracket 152 receives second drive block 162. This applies to each feed lift bracket 150 of motion bracket 152 receives third drive block 164.

Figure 8:
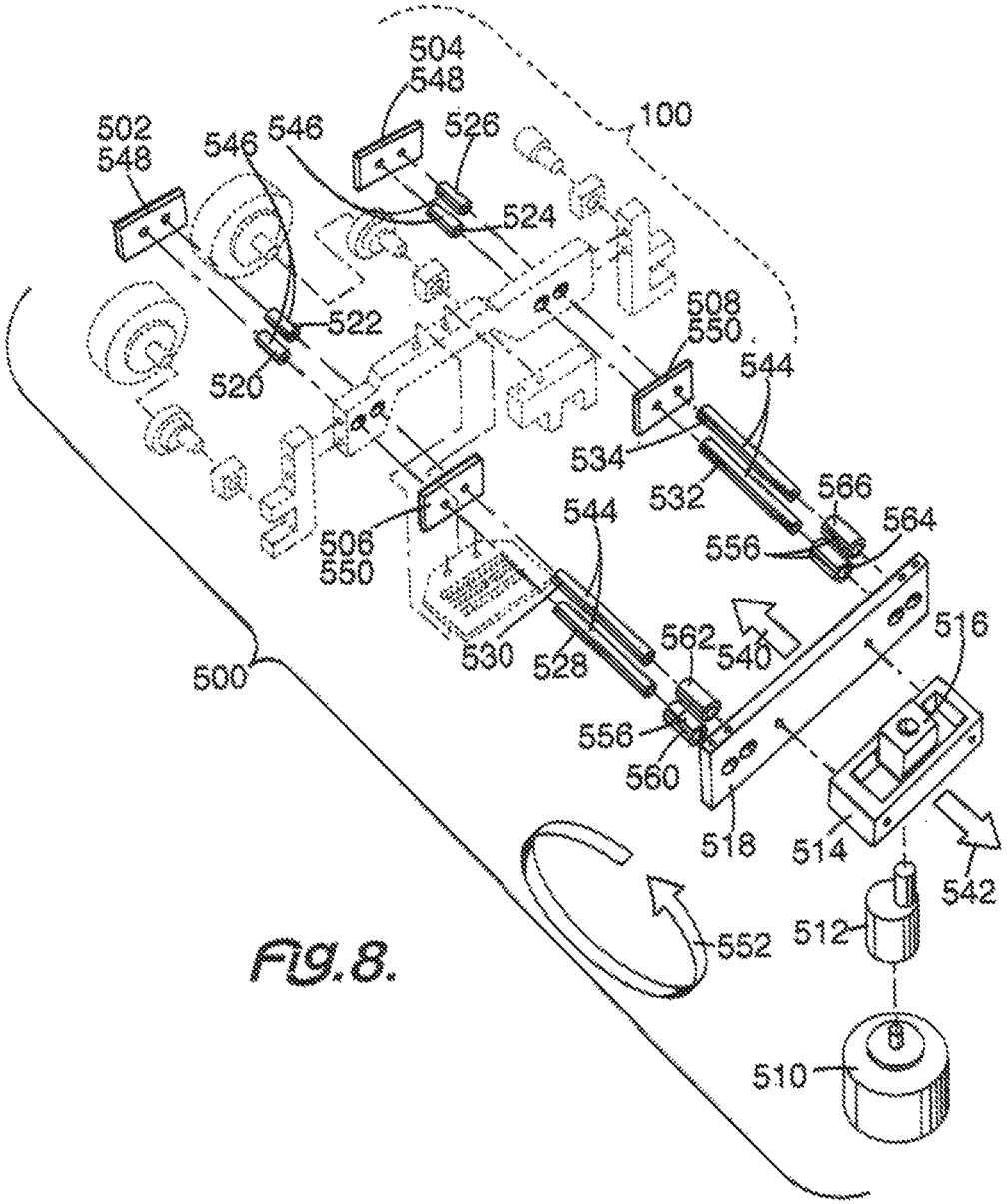
FIG. 8 depicts FIG. 1 in phantom, with an exploded view of a fourth sewing machine feed device added thereto in the form of a lateral eccentric guide 500, which cooperates with the sewing machine feed device 100 with the addition of components to achieve omni-directional feeding, while providing lateral eccentric motion 552 in cooperation with the sewing machine feed device 100 shown in phantom.

FIG. 8 provides an exploded view of a fourth embodiment for an omni-directional feed mechanism in the form of lateral eccentric guide 500. In this case, a lateral component (left or right) is added to the sewing machine feed device 100 of FIG. 1, which FIG. 1 is shown in phantom without numbers as cooperating with lateral eccentric guide 500. This arrangement allows the three motions to move completely independent from one another.

For the lateral eccentric guide 500, first cross travel guide plate 502 and second cross travel guide plate 504 are positioned on opposite sides of sewing machine feed device 100. Third cross travel guide plate 506 aligns with first cross travel guide plate 502. Fourth cross travel guide plate 508 aligns with second cross travel guide plate 504. Four spacers 546 in two pairs are positioned between the third cross travel guide plate 506 and first cross travel guide plate 502, and fourth cross travel guide plate 508 and second cross travel guide plate 504.

The four spacers 546 include first spacer 520 and second spacer 522, and third spacer 524 and fourth spacer 526. The first set of four apertures 548 appear in pairs in each of first cross travel guide plate 502 and second cross travel guide plate 504. The second set of four apertures 550 appear in pairs in each of third cross travel guide plate 506 and fourth cross travel guide plate 508. First spacer 520 and second spacer 522 connect a pair of the first set of apertures 548 and a pair of the second set of apertures 550. Third spacer 524 and fourth spacer 526 connect a separate pair of the first set of apertures 548 and a separate pair of the second set of apertures 550.

The cross travel servo motor 510 connects to the cross travel eccentric 512, which in turn connects to the cross travel bracket 514. Centered in the cross travel bracket 514 is the cross travel drive block 516. The cross travel bracket 514 is connected to the cross travel guide plate 518.

Bushings 566 contact cross travel guide plate 518 and guide rods 544. Guide rods 544 also contact second set of apertures 550 at the opposing end thereof. More particularly, bushings 566 include first bushing 560, second bushing 562, third bushing 564, and fourth bushing 566. Guide rods 544 include first guide rod 528, second guide rod 530, third guide rod 532 and fourth guide rod 534, each of which contact its own member of the second set of apertures 550.

Likewise first bushing 560 cooperates with first guide rod 528. Second bushing 562 cooperates with second guide rod 530. Third bushing 564 cooperates with third guide rod 532. Fourth guide rod 534 cooperates with fourth bushing 564.

This structure provides an inward movement 540 and an outward movement 542, as shown by the respective arrows. The lateral eccentric motion 552 is depicted by an arcuate arrow.

Figure 9:
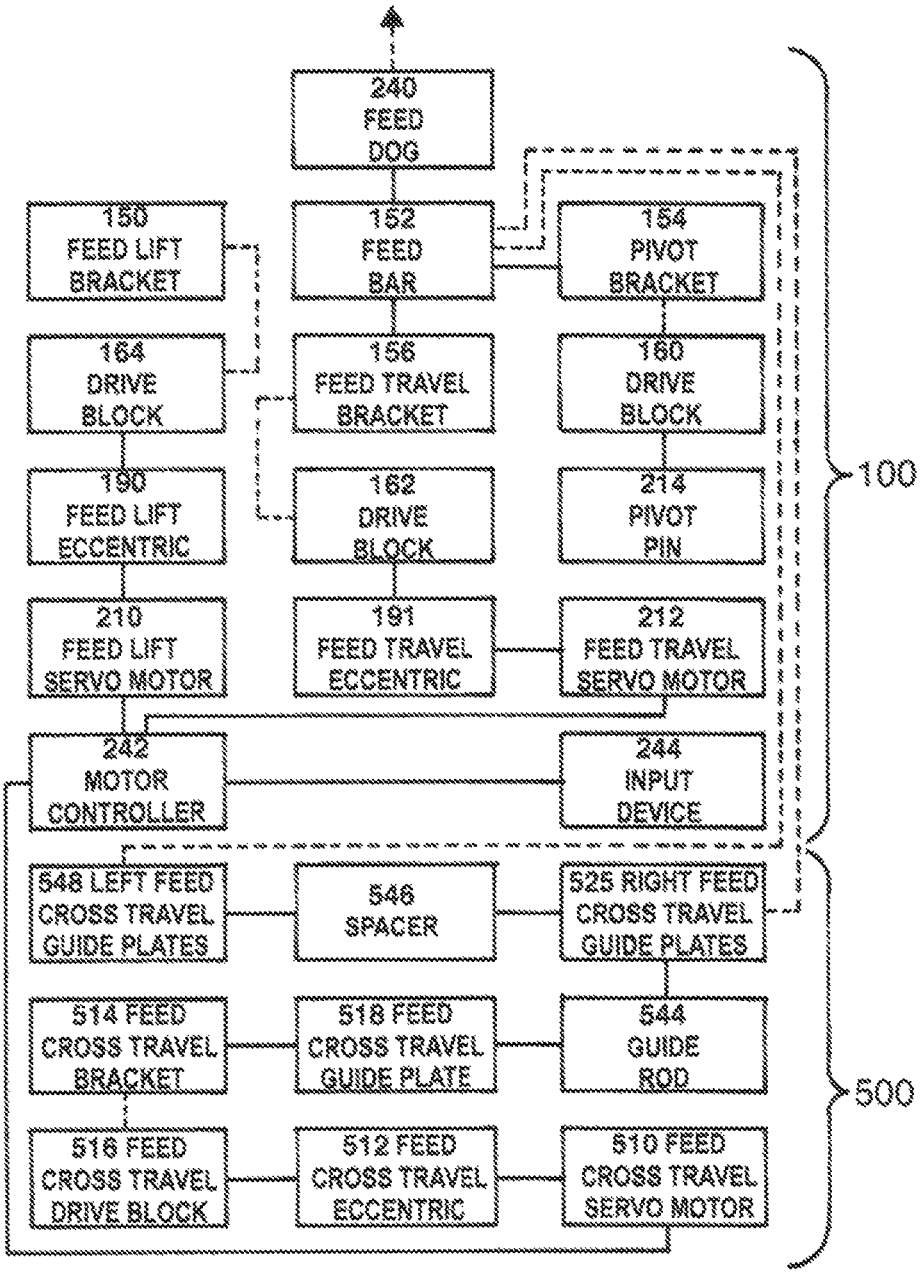
FIG. 9 depicts a box chart showing relationship of lateral eccentric guide 500 cooperating with the sewing machine feed device 100.

Turning now to FIG. 9, sewing machine feed device 100 cooperates with lateral eccentric guide 500. Sewing machine feed device 100 has feed lift bracket 150 cooperating with third drive block 164. The third drive block 164 is connected to the feed lift eccentric 190, which is in turn connected to motor controller 242.

Feed bar 152 is connected to both pivot bracket 154 and feed travel bracket 156. Feed travel bracket 156 is optionally connected to second drive block 162. Second drive block 162 is connected to feed travel eccentric 191, which is in turn connected to feed travel servo motor 212. Feed travel circular 212 connects to motor controller 242. Motor controller 242 follows instructions from input device 244. Also connected to pivot bracket 154 is first drive block 160 which receives pivot pin 214.

Motor controller 242 is connected to the feed cross travel servo motor 510 of the lateral eccentric guide 500. The feed cross travel servo motor 510 is connected to the feed cross travel eccentric 512, which in turn cooperates with the feed cross travel guide block 516. The feed cross travel guide block 516 cooperates with the feed cross travel guide bracket 514, which is connected to the center feed cross travel guide plate 518. Guide rods 544 supports the center feed cross travel guide plate 518 and the right feed cross travel guide plate 550. Spacers 546 separate the right feed cross travel guide plate 550 and left feed cross travel guide plate 548.

These arrangements allow fabric to be moved in any direction in the X-Y horizontal plane (X axis being the feed cross travel and Y axis being the feed travel). This method of fabric movement is useful for all sewing machines that produce a lockstitch (Stitch Type 301) where the stitch can be formed with the fabric moving forward, reverse, left, or right. Arcuate or elliptical movements are also permitted, especially with the structures as shown in FIG. 8 and FIG. 9.

For sewing machines that produce chainstitches (Stitch Types 401, 500's) the fabric must have some forward component of movement in order to properly form the stitch. A single omni-feed mechanism as described above can be used to replace the feed mechanism in single and multi-needle chainstitch machines and sergers to do curved or straight patterns. By combining two omni-feed mechanisms these types of machines can produce closed patterns that include inside and outside turns. The material can be rotated 360 degrees by placing one feed dog behind the needle and the other feed dog in front of the needle. By programming the two cross feed motors to move in opposite directions the fabric can be rotated.

This application, taken as a whole with abstract, specification, claims, and drawings being combined, provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A sewing machine feed device to cooperate with a sewing machine and feed a fabric in a desired direction comprising:

a) a driving means for the sewing machine feed device being separately drivable in relation to the sewing machine;

b) a feed mechanism feeding a sewn product independently of the sewing machine;

c) at least a rotational or a cross feed component being adapted to feed a material to a sewing machine in a desired direction;

d) an eccentric drive being added to the feed mechanism;

e) the feed mechanism and the eccentric drive cooperating to provide a choice of an x-axis or y-axis material feed, or a circular or an elliptical feed; and f) the feed mechanism for the sewing machine being separate from the sewing machine or incorporated as a part thereof.

2. The sewing machine feed device of claim 1 further comprising:

a) the lateral eccentric guide including a first cross travel guide plate and a second cross travel guide plate;

b) the first cross travel guide plate and the second cross travel guide plate being positioned on opposite sides of the sewing machine feed device;

c) the lateral eccentric guide further including a third cross travel guide plate and a fourth cross travel guide plate;

d) the third cross travel guide plate aligning with the first cross travel guide plate;

e) the fourth cross travel guide plate aligning with the second cross travel guide plate;

f) the lateral eccentric guide further including four spacers;

g) the four spacers including a first spacer, a second spacer, a third spacer and a fourth spacer;

h) a first set of four apertures appearing in pairs in each of the first cross travel guide plate and the second cross travel guide plate;

i) a second set of four apertures appearing in pairs in each of the third cross travel guide plate and the fourth cross travel guide plate, j) the first spacer and the second spacer connecting a pair of the first set of apertures and a pair of the second set of apertures;

k) the third spacer and the fourth spacer connecting a separate pair of the first set of apertures and a separate pair of the second set of apertures;

l) the feed mechanism including at least one feed dog; and m) the at least one feed dog moving in an elliptical path to transport the material over a throat plate.

3. The sewing machine feed device of claim 2 further comprising:

a) the feed mechanism including a vertical drive motor, a horizontal drive motor, and a rotational or a cross feed drive motor;

b) a motor controller being cooperatively connected to the vertical drive motor, the horizontal drive motor, and the rotational or the cross feed drive motor;

c) a programming device being cooperatively connected to the vertical drive motor, the horizontal drive motor, and the rotational or the cross feed drive motor;

d) a cross travel servo motor connecting to a cross travel eccentric;

e) the cross travel eccentric connecting to a cross travel bracket;

f) a cross travel drive block being centered in the cross travel bracket;

g) the cross travel bracket being connected to the cross travel guide plate;

h) a set of bushings contacting cross travel guide plate and a set of guide rods;

i) the set of guide rods also contacting the second set of apertures at the opposing end thereof; and j) an operator control panel being cooperatively connected to the vertical drive motor, the horizontal drive motor, and the rotational drive or the cross feed motor.

4. The sewing machine feed device of claim 3 further comprising:

a) a by stick input device operating the rotational or the cross feed drive motor component to steer the material as desired;

b) the sewing machine feed device including a feed bar;

c) a feed lift bracket communicating with the feed bar at a first bracket end;

d) the feed lift bracket communicating with the feed bar at a second bracket end;

e) the first bracket end being oppositely disposed from the second bracket end;

f) the set of guide rods including a first guide rod, a second guide rod, a third guide rod and fourth guide rod;

g) the set of bushings including a first bushing, a second bushing; a third bushing and a fourth bushing;

f) the first bushing cooperating with the first guide rod;

g) the second bushing cooperating with the second guide rod;

h) the third bushing cooperating with the third guide rod;

i) the fourth bushing cooperating with the fourth guide rod;

j) each of the first guide rod, the second guide rod, the third guide rod, and the fourth guide rod cooperating with its member of the second set of four apertures, k) the first set of four apertures appearing in pairs in each of the first cross travel guide plate and the second cross travel guide plate;

l) the second set of four apertures appearing in pairs in each of the third cross travel guide plate and the fourth cross travel guide plate;

n) a feed travel bracket being secured to the feed bar adjacent to the pivot bracket; and o) the sewing machine feed device thus having an inward movement and an outward movement.

5. The sewing machine feed device of claim 4 further comprising:

a) the rotational or the cross feed drive motor component including a first drive block, a second drive block and a third drive block;

b) the first drive block communicating with a pivot cradle on a pivot bracket;

c) the second drive block communicating with a feed travel drive block cradle on a feed travel bracket;

d) the third drive block communicating with a feed lift drive block cradle on a feed lift bracket;

e) a front end of the feed bar supporting the feed lift bracket;

f) a top end of the feed bar receiving the feed dog;

g) a back end of the feed bar having the pivot bracket secured thereto; and h) a bottom side of the feed bar having the feed travel bracket secured thereto.

6. The sewing machine feed device of claim 5 further comprising:

a) a feed lift eccentric communicating with the first drive block and being driven by a feed lift servo motor;

b) a feed travel eccentric communicating with the second drive block and being driven by a feed travel servo motor;

c) a pivot pin cooperating with the first drive block to provide cooperation between a vertical feed lift motion of the third drive block and a horizontal feed travel motion of the second drive block;

d) an elliptical motion being impart to the feed dog on the feed bar as the feed lift servo motor and the feed travel servo motor are rotated in conjunction.

7. The sewing machine feed device of claim 6 further comprising:

a) the feed lift servo motor being a vertical servo drive motor;

b) the feed travel servo motor being a horizontal servo drive motor; and c) the vertical servo drive motor and the feed travel servo motor being programmable to achieve an elliptical feed motion or a non-elliptical feed motion.

8. The sewing machine feed device of claim 7 further comprising:

a) the feed motion being slow to reduce damage to the fabric;

b) then feed motion being adjustable to affect stitch length can be programmed by adjusting the time span of the vertical motion or by advancing the vertical motion partially and then retracting the same.

9. The sewing machine feed device of claim 8 further comprising:

a) the vertical servo drive motor and the feed travel servo motor being programmable to achieve reverse feeding by changing the timing of when the vertical motion is activated relative to the horizontal motor;

b) a tacking operation being accomplished by programming the vertical servo drive motor and the feed travel servo motor to move the fabric forward one stitch length and back one stitch length for a set number of sewing machine cycles; and c) a basting operation being accomplished by programming the feed mechanism to feed the fabric for a long period.

10. The sewing machine feed device of claim 9 further comprising:

a) a third programmable servo motor feeding fabric in a selected direction or pattern;

b) the sewing machine feed device including a needle plate;

c) the needle plate being positioned on the sewing machine under a right turn indicator in order to feed the fabric in a controllable or flexible direction;

d) the needle plate being mounted over a support plate; and e) the support plate sitting on a first support post and a second support post.

11. The sewing machine feed device of claim 10 further comprising:

a) the first support post and the second support post providing a connection between the support plate and a rotational base plate;

b) a rail support plate being below the rotational base plate;

c) a guide rail being mounted between the rotational base plate and rail support plate;

d) the guide rail being to secured to the support plate;

e) a set of grooved rollers being secured to the rotational base plate;

f) the set of grooved rollers receiving the guide rail;

g) a segment gear being secured to the rotational base plate;

h) the segment gear meshing with a pinion gear; and i) the pinion gear being mounted on the rotational servo motor.

12. The sewing machine feed device of claim 11 further comprising:

a) the set of grooved rollers being four in number; and b) the set of grooved rollers being positioned on opposing sides of the guide rail.

13. In a sewing machine, the improvement comprising:

a) a feed device cooperating with the sewing machine to feed a fabric in a desired direction;

b) a driving means for the feed device being separately drivable in relation to the sewing machine;

c) the feed device cooperating with a lateral eccentric guide;

d) the feed device having a feed lift bracket;

e) the feed lift bracket cooperating with a third drive block;

f) the third drive block being connected to the feed lift eccentric; and g) the feed lift eccentric being connected to motor controller.

14. The sewing machine of claim 13 further comprising:

a) a feed bar being connected to both the pivot bracket and the feed travel bracket;

b) the feed travel bracket being connected to a second drive block;

c) the second drive block being connected to a feed travel eccentric; and d) the feed travel eccentric being connected to a feed travel servo motor.

15. The sewing machine of claim 14 further comprising:

a) the feed travel servo motor being connected to a motor controller;

b) the motor controller receiving instructions from an input device;

c) the pivot bracket being connected to a first drive block; and d) the first drive block receiving a pivot pin.

16. The sewing machine of claim 15 further comprising:

a) the motor controller being connected to the feed cross travel servo motor of a lateral eccentric guide;

b) the feed cross travel servo motor being connected to the feed cross travel eccentric; and c) the feed cross travel eccentric cooperating with the feed cross travel guide block.

17. The sewing machine of claim 16 further comprising:

a) the feed cross travel guide block cooperating with the feed cross travel guide bracket;

b) the feed cross travel guide bracket being connected to the center feed cross travel guide plate;

c) the guide rods supporting the center feed cross travel guide plate and the right feed cross travel guide plate; and d) the set of spacers separating the right feed cross travel guide plate and the left feed cross travel guide plate.

* * * * *